United States Patent [19]

Ross

[11] 4,201,269

[45] * May 6, 1980

[54] IMPACT DEVICE WITH LINEAR SINGLE ACTING AIR SPRING

[76] Inventor: Frederick W. Ross, 755 Klamath Dr., Del Mar, Calif. 92014

[ * ] Notice: The portion of the term of this patent subsequent to Mar. 29, 1994, has been disclaimed.

[21] Appl. No.: 894,093

[22] Filed: Apr. 6, 1978

Related U.S. Application Data

[62] Division of Ser. No. 762,003, Jan. 24, 1977, Pat. No. 4,099,580.

[51] Int. Cl.[2] ..... E25B 15/00

[52] U.S. Cl. ..... 173/1; 173/116; 173/118

[58] Field of Search ..... 173/1, 116, 117, 118, 173/119

[56] References Cited

U.S. PATENT DOCUMENTS

| | | | |
|---|---|---|---|
| 2,880,585 | 4/1959 | Badcock | 173/118 |
| 3,688,848 | 9/1972 | Vick et al. | 173/118 X |

FOREIGN PATENT DOCUMENTS

| | | | |
|---|---|---|---|
| 2438938 | 2/1976 | Fed. Rep. of Germany | 173/118 |
| 2439039 | 2/1976 | Fed. Rep. of Germany | 173/116 |
| 3153 | of 1914 | United Kingdom | 173/118 |

*Primary Examiner*—Lawrence J. Staab

[57] ABSTRACT

An impact device incorporating an improved air spring coupler in the form of a novel cylinder-piston is disclosed, in which the air spring is linear, i.e., the air spring stiffness is substantially constant over the operating range of the air spring displacement. Selected relations between piston area, ram mass, cylinder volume and equivalent length, crank radius, frequency of impacts and power available in the impact device are disclosed for which the improvement of such linear air spring stiffness is obtained for preferred embodiments.

5 Claims, 8 Drawing Figures

IMPACT DEVICE WITH LINEAR SINGLE ACTING AIR SPRING

This is a division, of application Ser. No. 762,003, filed Jan. 24, 1977 now U.S. Pat. No. 4,099,580.

CROSS REFERENCE TO RELATED APPLICATIONS

This invention relates to improvements in air spring couplers of the type set forth in my copending application Ser. No. 534,626 filed Dec. 19, 1974 now U.S. Pat. No. 4,014,392.

BACKGROUND OF THE INVENTION

It is known that impact devices, such as demolition hammers powered by electric motors, incorporate resilient means for coupling motion of a reciprocating body into impacting motion of a ram. In my copending application, Ser. No. 534,626, it is disclosed that all known or cited prior art references utilizing some type of piston-cylinder coupler for such resilient means, incorporate air cushions or other air spring arrangements which have highly non-linear forcedisplacement spring characteristics. Such non-linearities generate wasteful extraneous harmonic vibrations and unnecessary heating, which cause considerable inefficiency and ineffectiveness of such air springs, as well as causing considerable wear and service problems for the impact device. Application Ser. No. 534,626 discloses an invention which tends to remove deficiencies of such prior art structures.

SUMMARY OF THE INVENTION

The linearized air spring of the present invention incorporates novel locations for flow-restricting vent means which importantly reduce the air spring size and weight of those disclosed in Ser. No. 534,626, while also retaining the linearized force-displacement characteristics disclosed therein, by incorporating small venting means in the zone of the cylinder end element closest to the impact tool in addition to small vents located medially of the cylinder length as disclosed in Ser. No. 534,626.

An alternate embodiment includes only a circumferential ring of small vents through the cylinder wall approximately 25% of the cylinder length from the end nearer the impact tool.

By means of the invention the length of the cylinder is reduced by more than 25%, thereby effecting important reductions in the size and weight of the impact device for the same effectiveness and performance.

Linearized air springs in the form of improved single acting air springs are disclosed in three additional embodiments.

Two alternate improved high strength pistons and an improved connecting rod yoke for incorporation with such linearized air springs are also disclosed.

DETAILED DESCRIPTION OF THE PREFERRED EMBODIMENTS

Figure 1:
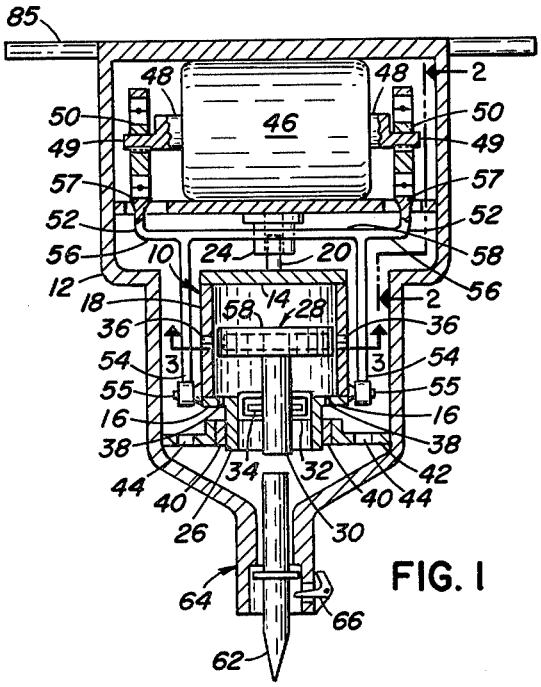
FIG. 1 is a front view, partially cutaway, of an impact device according to the invention incorporating a double acting air spring with stabilizing vents located in the end region of the cylinder as well as in the mid length region and with a double-offset connectng rod yoke.
Figure 2:
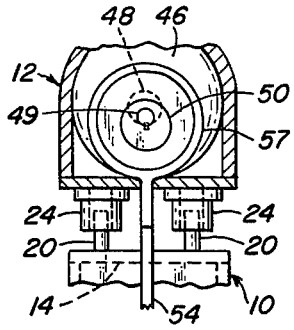
FIG. 2 is a partial sectional view of the device taken along line 2—2 of FIG. 1.
Figure 3:
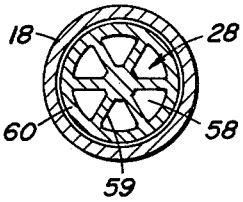
FIG. 3 is a partial sectional view taken along line 3—3 of FIG. 1.

Referring to the drawings, FIGS. 1 through 3 illustrate a preferred embodiment of the invention incorporating a modified embodiment of the resilient coupler and exciter-reciprocative means disclosed in my copending application, Ser. No. 534,626, filed Dec. 19, 1974.

Cylinder-piston means 10 is mounted for reciprocation on frame 12, which also serves as an enclosing case, and comprises barrel 18 with enclosing end elements 14 and 16 secured thereto. Cylinder-piston means 10 has two cylinders 20, each secured to end element 14 and located to extend up (i.e. toward handle 85) from opposing sides of the axis of barrel 18, and fitted for sliding in matching barrels 24 secured to frame 12. Barrel 26 secured to end element 16 and extending downward therefrom is located coaxially with respect to barrel 18 and is fitted for slidable reciprocation in bushing 40 mounted on cross element 42 of frame 12. Vents 44 through cross element 42 allow air to pass from one side thereof to the other for reducing pressure build-up across element 42.

Piston 28, sealably and slidably fitted for reciprocation along an axial path in barrel 18, has piston shaft 30 secured thereto. Piston shaft 30 extends slidably and sealably through seal ring 34 mounted in a circumferential slot in bushing 32, which is coaxially mounted in lower end element 16. Seal ring 34 is a split ring of solid material, preferably metal, split at one radial point as are piston rings commonly used in internal combustion engines, but differs therefrom in that seal ring 34, when not installed, tends to seek a diameter smaller than the outside diameter of piston shaft 30, and the inner surface of seal ring 34, rather than its outer surface, is finished to provide sealing between it and piston shaft 30 as it fits resiliently around piston shaft 30 when installed as shown in FIG. 1. Barrel 18, end elements 14 and 16, piston shaft 30, bushing 32, and seal ring 34 substantially enclose a total enclosed space, $V_t$ substantially confining a selected quantity of air of mass, $m_t$. Piston 28 divides such total enclosed space into an upper enclosed space of volume, $V_u$, toward upper end element 14, i.e., away from the impacting tool means, and a lower enclosed space of volume, $V_L$, toward lower end element 16, i.e., toward the impacting tool means.

Flow restricting passage means for stabilizing the excursion of piston 28 during operation includes a circumferential ring of vents 36 through the wall of barrel 18 located substantially medially of the length thereof, where the length, $h_t$, is equal to $V_t/A$, where A is the inside cross-sectional area of barrel 18 at the vents, as disclosed in my copending application, Ser. No. 534,626, plus the incorporation of additional vents 38 in lower end element 16.

Piston 28 comprises a web having thin portions 58 of substantially constant thickness and radial rib portions 59 for added strength to withstand strong axial impulses transmitted thereto from impacting of shaft 80 against tool means 62, thus the web with thin portions 58 and radial rib portions 59 has an average circumferential thickness which varies from a maximum at the attachment to shaft 80 to a minimum at depending skirt 60, as discussed in my copending application, Ser. No. 534,626.

Rotary motor 46 with rotor shaft 48 is mounted on frame 12, preferably but not necessarily, with the rotational axis of rotor shaft 48 located at right angles or normal to the axial path of reciprocation. Rotor shaft 48, which extends from both ends of rotary motor 46, preferably has a reduced diameter offset end element 49 formed eccentrically in each end thereof, the axis of each offset end element 49 being displaced radially from and parallel with the axis of rotation of rotor shaft 48, each at substantially the same radial distance and in the same rotational phase relative to the rotational axis of rotor shaft 48, preferably with the circumferential point (on offset end element 49) which is most remote from the axis of rotor shaft 48 being a distance therefrom no greater than the radius of rotor shaft 48. This latter limitation provides the maximum radius for the axis of offset end element 49 from the axis of shaft 48 without offset end element 49 extending radially from the axis of shaft 48 beyond the radius of the outer surface of shaft 48. With such arrangement of structure non-split rotor shaft bearings can be slipped past offset end elements 49 for a crank arm which is integral (i.e. in one piece) with shaft 48, and non-split crank bearings can be utilized and mounted more closely adjacent the rotor shaft bearings, thereby reducing shaft vibrational deflections and losses occurring therefrom during operation. Additionally, by incorporating an eccentric 50, as shown in FIGS. 1 and 2, a greater crank radius can be obtained than with an offset end element alone and thus retain all the improvements thereof. An eccentric 50 is pressed and keyed over each offset end element 49, each eccentric 50 being positioned with its direction of eccentricity substantially aligned with that of the respective offset end element on which it is pressed and keyed, the outer diameter of eccentric 50 thereby serving as a crank pin. Such eccentric offset elements and eccentrics serve as cranks and rotor shaft 48 as a crankshaft.

Connecting rod yoke 52 comprises cross element 58 and two connecting rod branches, each such branch positioned substantially symmetrically on opposite sides of cylinder-piston 10 and each having a main connecting rod element 54, a substantially parallel offset element 57 and a cross arm element 56 which latter joins element 54 to element 57. Each connecting rod branch interconnects an eccentric 50 to a wrist pin 55 secured on an opposite side of cylinder-piston means 10 as at lower end element 16. Cross arm element 56, preferably positioned perpendicular to the respective connecting rod elements 54 and 57 may be at other angles thereto, for which arrangement matching connecting rod elements 54 and 57 would be shortened accordingly to maintain total length of connecting rods the same. Cross element 58, secured between the two branches of the connecting rod yoke for support therebetween, is preferably collinear with cross arm elements 56 positioned perpendicular to connecting rod elements 54 and 57. Offset elements 57 are fitted over the crank pins represented by eccentrics 50 with suitable bearings as by commonly used means.

Piston 28 with piston shaft 30 secured thereon, preferably has high strength structure with web 58, ribs 59, and depending skirt 60, such high strength structure being preferably utilized in combination with the relatively larger diameter of piston required with the linearized cylinder-piston means of the present invention.

Impact output means comprises an impact tool 62 slidably mounted in tool holder means 64 in position on frame 12 to receive impacting from piston shaft 30, the latter being ram means for transmitting reciprocation of the piston and shaft to impacting on the impact tool. Releasable retainer 66, which restricts axial motions of impact tool 62 to prevent release therefrom during operation, can be released for removing the impact tool.

Figure 4:
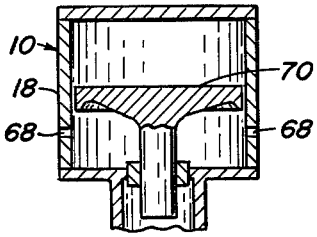
FIG. 4 is a partial front view of an embodiment of the invention illustrating a double acting air spring with stabilized vents located only in the mid region of the lower half of the cylinder.

FIG. 4 illustrates an alternate embodiment of cylinder-piston means 10 for which the restricted flow passage means comprises only a ring of vents 68 positioned substantially in the mid range of the lower half of the open length, $h_L$, where $h_L$ equals one half of $h_t$ as defined hereinbefore. Piston 70 is of the tapered-flanged high strength type disclosed in my copending application, Ser. No. 534,626. Piston 70 has a shaft secured thereon with a fillet at the attachment.

Figure 5:
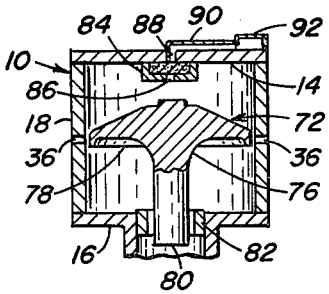
FIG. 5 is a partial front view of an embodiment of the invention illustrating a piston-ram with a gradually tapering transition section between a tapered web piston and a straight piston shaft, and a double acting air spring in the form of a cylinder-piston with end vent means in the form of an oversized bushing for the piston shaft support in addition to vents located in the mid length region of the cylinder.

FIG. 5 illustrates an alternate embodiment of cylinder-piston means 10 for which the restricted passage means includes a circumferential ring of vents 36 through the wall of barrel 18 located substantially medially of the length thereof such as shown in FIG. 1. In the embodiment shown in FIG. 5, however, the venting through end element 16 is through an oversized gap or clearance between the inside diameter of bushing 82 and the outside diameter of constant-diameter shaft 80. Such oversized clearance also reduces problems of friction and binding between bushing 82 and constant-diameter shaft 80. Typical oversized clearances are greater than five times the diametrical clearances of 0.1 percent, typical in the related prior art.

FIG. 5 also illustrated an improved piston for which the constant-diameter shaft 80 is secured to a tapered piston web through a transition portion 76 having a gradually increasing diameter for which the taper increases gradually from a small percentage increase in diameter from tangency at the junction with constant-diameter shaft 80 to a diameter more than double at the tapered web to terminate with a profile portion perpendicular to the axis of constant-diameter shaft 80 and tangent to the tapered web 78. Transition portion 76 is greater than 20% of the length of constant-diameter shaft 80 and thus is distinguished from a fillet as shown in FIG. 4, for which the corresponding length (along the piston axis) is somewhat less than 5%.

FIG. 5 also illustrates a means for lubricating the inside wall of barrel 18. Cup 84, secured substantially coaxially to the inside wall of end element 14, has restricting orifice 86 opening the interior of cup 84 to the interior of barrel 18. Cup 84 is packed loosely with suitable porous material which can absorb lubricating oil and thus serve as a reservoir to hold such oil which is thrown out through restricting orifice 86 on to piston 72 during operation of the impact device and hence to dispense lubricating oil as needed during operation. Preferably, the top of piston 72 is shaped as shown so that oil thrown thereon will drain more readily on to the inner wall of barrel 18 therefrom as shown in FIG. 5. Orifice 88 in end element 14 with duct 90 and cup 92, the latter with an opening in the top thereof, all serve as means for replenishing the supply of lubricating oil in cup 84 when the device is not in operation. Cup 92, preferably, has a removable cap thereon (not shown) to close the opening in the top thereof to prevent oil from being thrown out of the opening during reciprocation of end element 14.

Figure 6:
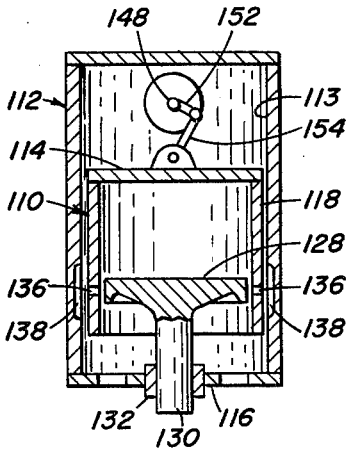
FIG. 6 is a partial view of an embodiment of the invention illustrating a single acting air spring in the form of a cylinder-piston with cylinder enclosed at one end only and reciprocated by a single connecting rod.

FIG. 6 illustrates an alternate embodiment of the cylinder-piston of the invention comprising a single-acting air spring shown as cylinder-piston means 110 with barrel 118 and end element 114 sealing only one end thereof. Cylinder-piston means 110 is guided for reciprocation as by cylindrical cavity 113 formed in frame 112, and piston 128 of similar high strength shape as that of FIG. 4, has piston shaft 130 which is slidably supported for reciprocation in bushing 132, mounted in open bulkhead 116 of frame 112. Barrel 118, end element 114, and piston 128 form an enclosed space of variable volume enclosing a substantially constant quantity of air, the enclosed air and enclosed space thereby forming a single acting air spring.

Cylinder-piston means 110 is reciprocated in cylindrical cavity 113 as by connecting rod 154 and crank 152 by rotation of crankshaft 148 mounted for rotation on frame 112 by means well known in the art.

Vents 136 located substantially in a circumferential ring near the open end of barrel 118 provide means for air flow into the enclosed space substantially enclosed by end element 114, barrel 118, and piston 128. At the reciprocative position where the top of piston 128 passes to the top of vent 136, the vents are closed and determine a close-off volume $V_c = Ah_c$ where A is the cross-sectional area of barrel 218 and $h_c$ is the equivalent open length of the air spring. Slots 138 in the wall of cylindrical cavity 113 provide means for air to pass into and out of the otherwise enclosed space to compensate for leakage past the piston during upward compressive motion of piston 128.

Figure 7:
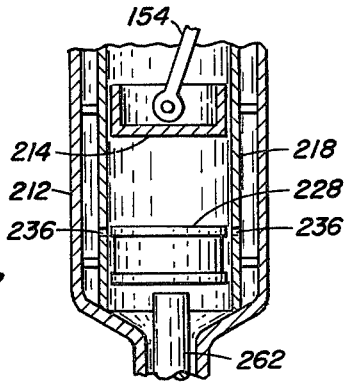
FIG. 7 is a partial view of an embodiment of the invention illustrating a single acting air spring in the form of a cylinder with two pistons, one reciprocated by a single connecting rod and a second piston free for reciprocation in the cylinder by action of the first piston, the cylinder being fixed to the device frame.

FIG. 7 illustrates an alternate embodiment of a single acting air spring comprising a vented barrel 218 with vents 236 near the lower end thereof. Driver piston 214 serves both as an element for closing off the upper end of barrel 218 and as means for inducing reciprocation in ram piston 228 which serves the same purpose as piston 128 in FIG. 6 except piston 228 serves as ram means to impact directly against impact tool means 262 without a shaft for making contact at impact as for shaft 130 of FIG. 6. It is evident that for either of the embodiment of FIGS. 6 and 7 piston 128 or piston 228 can impact directly against the impact tool as in FIG. 7 or the impact can be through the medium of a shaft with bushing guide support therefor as in FIG. 6. Connecting rod 154 of FIG. 7, as for connecting rod 154 of FIG. 6, reciprocates piston 214 thereby periodically varying the pressure of the air enclosed in the variable enclosed space enclosed by barrel 218, driver piston 214 and ram piston 228. With ram piston 228 at the close-off position as described hereinbefore and drive piston 214 at its mid excursion position a close-off volume, $V_c = Ah_c$, is determined, A and $h_c$ being defined as hereinbefore.

Figure 8:
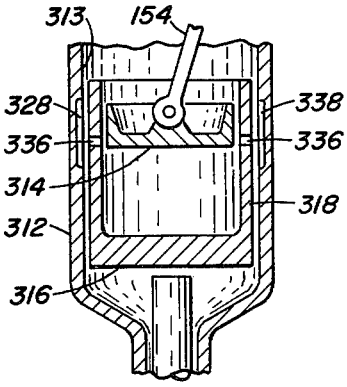
FIG. 8 is a partial view of an embodiment of the invention illustrating a single acting air spring in the form of a cylinder-piston with a single connecting rod reciprocating a piston in a cylinder formed as part of a reciprocating ram.

FIG. 8 illustrates an alternate embodiment of a single acting air spring comprising vented cylinder 318 with a circumferential ring of vents near the upper end and with an end element 316 secured to and closing off the lower end thereof. End element 316 is thicker (e.g. than end element 14 of FIG. 1) and of high strength material to serve also as ram. It is evident that a coaxially positioned shaft could be positioned on end element 316 to serve as ram as shown in FIG. 6. Cylinder 318 is fitted for reciprocation along a path collinear with its axis in matching cavity 313 formed in frame 312. Slots 338 in the wall of frame 312 provide space for air to flow into and out of vents 336 at all positions of reciprocation of cylinder 318 during operation.

Drive piston 314, driven into reciprocation by connecting rod 154 as illustrated in FIG. 6, e.g., closes off an enclosed space of variable volume, $V_{cL}$, as defined for the similar enclosed space for FIG. 7. With drive piston 314 at the close-off position shown in FIG. 7, a substantially constant mass of gas or air is confined in the enclosed space.

In each of the respective enclosed spaces of the embodiments illustrated in FIGS. 1 and 4–8, a substantially constant quantity of air is enclosed at a pressure, $p_i$, substantially that of the pressure of the air outside of the respective barrel in the immediate vicinity of the vents 36, 68, 136, 236, or 336, respectively; and the reciprocation of the enclosing end element of each of the embodiments, whether end element 14 secured to barrel 18, as in FIGS. 1, 4, or 5, end element 114 secured to barrel 118 as in FIG. 6, drive piston 214 of FIG. 7, or drive piston 314 of FIG. 8, is the principal means which induces the ram into impacting. Barrel 118 of FIG. 6 reciprocating with end element 114 and barrel 318 of FIG. 8 reciprocating with piston 314 will contribute only a minor proportion of such driving effect. In FIG. 7, the barrel is stationary relative to the frame and contributes nothing to induce reciprocation. Such distinctions regarding whether the barrel reciprocates with the driving piston, or the ram or neither, are unimportant to the essential functioning of the invention as described hereinbelow, the reciprocation of the end element being the principal means by which the reciprocative impacting motion of the ram means is induced.

All embodiments of the present invention, although differentiated in specific details comprise an enclosing wall with vents having (1) a cylindrical portion or barrel element, (2) at least one end element of such wall which is driven into reciprocation by some suitable exciter-reciprocative means such as disclosed hereinabove or as disclosed in my copending applications: Ser. No. 534,626, filed Dec. 19, 1974 and Ser. No. 742,109, filed Nov. 15, 1976, and (3) at least one piston or ram surface for transmitting varying air pressure generated within the enclosing wall by such reciprocation of the end element to the piston or ram to induce, resiliently, impacting motion thereof.

In my copending application, Ser. No. 534,626 an embodiment is disclosed having a cylinder with end elements secured to each end of a barrel or cylinder with vents located in a circumferential ring substantially at the mid cylinder length. With such vent positioning and the relative positions of the impact tool, the cylinder-piston is a double acting air spring made up of two substantially equal opposing single acting air springs. The embodiments in FIGS. 1–4 herein disclose cylinder-piston means also double acting but each made up of two unequal opposing single acting air springs. For the embodiment in FIG. 1, this difference between equal and unequal opposing single acting air springs is effected by incorporating additional vents in the end zone of the enclosing wall, such as end vents 38 in end element 16, in addition to and of substantially the same flow area as those at the mid length position as disclosed for the embodiment in Ser. No. 534,626. Such vent location, with both mid and end positions for the vents, positions the effective center of the vent area at an equivalent cylinder length where the lower half volume of the total enclosed space is substantially divided in half. Such conditions are obtained with vent flow areas restricted to only sufficient area to bleed sufficient stabilizing air into and out of the enclosing wall to stabilize the average position of the excursion of the piston during operation as disclosed in Ser. No. 534,626.

In FIG. 4 a similar effect is obtained by grouping the vents only in substantially one circumferential ring in a position along the equivalent length of barrel 18 which divides the lower half volume of the total enclosing wall substantially in half.

The important improvement, gained by such placement of vents, as in FIGS. 1 and 4 away from the mid barrel location, is a reduction of more than 25% in the overall length of the cylinder-piston means 10 for a cylinder-piston means which will perform the same functions as a cylinder-piston means with the vents located in the mid cylindrical position as in Ser. No. 534,626. This improvement is of particular importance because of the importance of keeping the overall weight and size of such impacting devices minimum for a requied performance.

For double acting air springs as shown in FIGS. 1, 4, and 5, the air spring force, $F_d$, as it changes with displacement x of the piston away from the point where the air pressure is the same on both sides of the piston, is obtained from the gas law of physics, $p_iA(V_i/V)^n$, as follows:

$$F_d = P_iA[(1 - \frac{x}{r_h h_t})^{-n} - (1 + \frac{x}{(1 - r_h)h_t})^{-n}], \quad \text{Eq. (1)}$$

where $p_i$ is the pressure outside the enclosing wall in the immediate vicinity of the flow restricting vents, A is the inside cross-sectional area of the barrel where the piston slides therein, $V_i$ is the enclosed volume on one side of the piston determined with the piston at a point of displacement where its outer surface area is centered (lengthwise of the barrel) over the center of the area of the vents, V is the volume on one side of the piston at any one point, x, during piston excursion away from the center of the area of the vents and toward the upper end element, and n is a gas constant equal to the ratio of specific heats if there are no air leaks or heat losses during compression or decompression, and which in practice is equal to approximately 1.3 for air in a typical such cylinder-piston arrangement. $h_t$ is the total equivalent open length of the total enclosed space $V_t$ within the enclosing wall less the volume of the piston and piston shaft with the piston surface adjacent the cylinder inside wall centered over the area center of the vents and $h_t = V_t/A$. $r_h$ is the ratio of the volume on the side of the piston toward the upper end element when centered over the vents, to $V_t$. Thus for prior art embodiments as disclosed in my copending application, Ser. No. 534,626, in which the vents are centered to make the volumes substantially equal on each side of the piston $r_h = \frac{1}{2}$, whereas for the embodiments of FIGS. 1, 4, and 5, $r_h = \frac{3}{4}$.

For single acting air springs as shown in FIGS. 6, 7, and 8, the air spring force, $F_s$, varies with piston position, x, where x=0 at the closeoff position and is positive for piston displacements toward the enclosed end of the barrel. According, $$F_s = p_iA(1 - x/h_c)^{-n} - P_iA, \quad \text{Eq. (2)}$$

where $h_c$ is the close-off volume and A the piston area as defined hereinabove.

The embodiments of the invention are distinguished from cylinder-piston arrangements of the prior art thus: the piston diameter and accordingly the barrel cross-sectional area are increased sufficiently over those of typical prior art devices incorporating single acting air springs to determine sufficient air spring stiffness, $k_s$, so that all the kinetic energy of the piston immediately prior to impact, i.e., substantially at x=0, during each reciprocation is stored as potential energy in the air spring at piston maximum excursions less than 0.7 $h_c$ away from cut-off position; or, in other words, that the piston, during operation, does not approach the upper end element closer than the point at which the remaining enclosed volume is 0.3 $h_cA$.

From the mathematical expression for both $F_d$ and $F_s$, as stated hereinabove, the equivalent spring stiffness, k, over the particular range of excursions under consideration is substantially determined as the mathematical relation:

$$k_d = \frac{2}{x_m^2} \int F_d dx \quad \text{Eq. (3)}$$

for the double acting air spring, and $$k_s = \frac{2}{x_m^2} \int F_s dx \quad \text{Eq. (4)}$$

for the single acting air spring, where the integrations are from x=0 to $x = x_m$, the latter being the maximum excursion x.

The restriction of the maximum piston excursion to less than 0.7 $h_c$, i.e. to a point for which the remaining open volume in the air spring is greater than 0.3 $h_cA$, limits the air spring displacements to a substantially linear portion of Eqs. (1) and (2) respectively, i.e. to that portion of the respective curves of $F_d$ and $F_s$ for which the increase from x=0 of $F_d$ or $F_s$ with increase of x, is substantially constant (i.e. linear). Such limitation of piston displacement is obtaned by selecting the ratio of terms $P_iA/h_t$ or $p_iA/h_c$ respectively from Eqs. (1) and (2), along with a selected value for the mass of the piston, and shaft if any, and impacts per second of the impact device, and crank arm radius as set forth in my copending application, Ser. No. 534,626.

In the foregoing disclosures reference to "upper" or "lower", used for simplicity of description, is intended to signify "away from" or "toward" the impact tool end of the impact device regardless of orientation of the impact device with respect to the earth's surface.

Barrel 18 here shown preferably as having a circular cross-section may be of any other cross-section, it only being necessary that it be a cylinder generated from a closed path normal to the path of reciprocation by straight lines passing through the closed path and parallel to the path of reciprocation. Likewise end elements need not be flat as here shown but may be of any other shape which will produce the effects described hereinabove.

Having thus described the invention, I claim:

1. The method of operating an impacting device of the type wherein a rotating crankshaft having at least one crank thereon actuates resilient coupler means mounted on a frame to drive ram means into impacting motion against impact tool means upon each rotation of the crankshaft, and the resilient coupler means comprises a single acting air spring including a vented cylinder mounted for reciprocation in the frame upon rotation of the crankshaft an end element enclosing only one end of the cylinder, and the ram means including a piston slidably mounted in the cylinder and arranged to close the vent and enclose an internal open space of variable volume in the cylinder upon each rotation of the crankshaft, wherein th method comprises:

for a selected frequency $w_o$ of crankshaft rotation and a selected mass m of said ram means; providing a sufficiently short crank length and, in combination therewith, selecting the piston with sufficient cross-sectional area A normal to the path of piston motion and arranging the cylinder and vent location to enclose a substantially constant quantity of air of volume Ah at pressure $p_i$ upon each enclosure of the internal open space by the piston during each cycle of crankshaft rotation to determine a ratio $p_iA/h$ providing air spring stiffness k for said resilient coupler means of sufficient magnitude to limit piston travel toward said end element during impacting operation to the point in piston travel at which the minimum volume of said internal open space is 0.3 Ah thereby restricting such excursions within a range for which said air spring stiffness is substantially constant, and further providing sufficient magnitude for said air spring stiffness k, in combination with said selected mass m, to provide a magnitude of natural frequency $w_n$ of the air spring ram mass combination equal or sufficiently close to the selected frequency $w_o$ of said rotating crankshaft to insure driving said ram means during impacting operation into reciprocating excursions greater than said sufficiently short crank length thereby inducing dynamic amplification of the motion of said ram means.

2. The method of operating an impacting device of the type wherein a rotating crankshaft having at least one crank thereon actuates resilient coupler means mounted on a frame to drive ram means into impacting motion against impact tool means upon each rotation of the crankshaft, and the resilient coupler means comprises a vented cylinder secured in said frame with a drive piston slidably and sealably fitted for reciprocation in said cylinder upon rotation of the crankshaft and substantially enclosing one end portion of the cylinder, with the ram means including a ram piston slidably mounted in the cylinder and arranged to close the vent, said drive piston, said ram piston and said cylinder arranged to form a single acting air spring enclosing an internal open space of variable volume in the cylinder upon each rotation of the crankshaft, wherein the method comprises:

for a selected frequency $w_o$ of crankshaft rotation and a selected mass m of said ram means; providing a sufficiently short crank length and, in combination therewith, selecting the piston with sufficient cross-sectional area A normal to the path of piston motion and arranging the cylinder and vent location to enclose a substantially constant quantity of air of volume Ah at pressure $p_i$ with said drive piston at the mean excursion point thereof upon each enclosure of the internal open space by the ram piston during each cycle of crankshaft rotation to determine a ratio $p_iA/h$ providing air spring stiffness k for said resilient coupler means of sufficient magnitude to limit ram piston travel toward said at least one end element during impacting operation to the point in piston travel at which the minimum volume of said internal open space is 0.3 Ah, thereby restricting such excursions within a range for which said air spring stiffness is substantially constant, further providing sufficient magnitude for said air spring stiffness k, in combination with said selected mass m, to provide a magnitude of natural frequency $w_n$ of the air spring ram mass combination equal or sufficiently close to the selected frequency $w_o$ of said rotating crankshaft to insure driving said ram means during impacting operation into reciprocating excursions greater than said sufficiently short crank length thereby inducing dynamic amplification of the motion of said ram means, said cylinder, said ram piston, said drive piston, and the air enclosed thereby comprises a single acting air spring.

3. The method of operating an impacting device of the type wherein a rotating crankshaft having at least one crank thereon actuates resilient coupler means mounted on a frame to drive ram means into impacting motion against impact tool means upon each rotation of the crankshaft, and the resilient coupler means comprises a vented cylinder slidably mounted for reciprocation in a frame, an end element secured to one end of the cylinder, the ram means including said cylinder and said end element secured thereto, and a drive piston slidably and sealably mounted in the cylinder and arranged to close the vent, said cylinder, said end element and said piston thereby forming a single acting air spring substantially enclosing an internal open space of variable volume in the cylinder upon each rotation of the crankshaft, wherein the method comprises:

for a selected frequency $w_o$ of crankshaft rotation and a selected mass m of said ram means; providing a sufficiently short crank length and, in combination therewith, selecting the piston with sufficient cross-sectional area A normal to the path of piston motion and arranging the cylinder and vent location to enclose a substantially constant quantity of air of volume Ah at pressure $p_i$ upon each enclosure of the internal open space by the piston during each cycle of crankshaft rotation to determine a ratio $p_iA/h$ providing air spring stiffness k for said resilient coupler means of sufficient magnitude to limit piston travel toward said at least one end element during impacting operation to the point in piston travel at which the minimum volume of said internal open space is 0.3 Ah, thereby restricting such excursions within a range for which said air spring stiffness is substantially constant, and further providing sufficient magnitude for said air spring stiffness k, in combination with said selected mass m, to provide a magnitude of natural frequency $w_n$ of the air spring ram mass combination equal or sufficiently close to the selected frequency $w_o$ of said rotating crankshaft to insure driving said ram means during impacting operation into reciprocating excursions greater than said sufficiently short crank length thereby inducing dynamic amplification of the motion of said ram means.

4. The method of operating an impacting device of the type wherein exciter-reciprocative means having a reciprocating output element actuates resilient coupler means mounted on a frame to drive ram means into impacting motion against impact tool means upon each reciprocation of the reciprocating output element, and the resilient coupler means comprises a single acting air spring including a vented cylinder mounted for reciprocation in the frame upon reciprocation of the reciprocating output element, an end element enclosing only one end thereof, and the ram means including a piston slidably mounted in the cylinder and arranged to close the vent and enclose an internal open space of variable volume in the cylinder upon each reciprocation of the reciprocating output element, wherein the method comprises:

for a selected frequency $w_o$ of reciprocation of the reciprocating output element and a selected mass m of said ram means; providing a sufficiently short maximum excursion of the reciprocating output element and, in combination therewith, selecting the piston with sufficient cross-sectional area A normal to the path of piston motion and arranging the cylinder and vent location to enclose a substantially constant quantity of air of volume Ah at pressure $p_i$ upon each enclosure of the internal open space by the piston during each cycle of reciprocation of the reciprocating output element to determine a ratio $p_iA/h$ providing air spring stiffness k for said resilient coupler means of sufficient magnitude to limit piston travel toward the end element during impacting operation to the point in piston travel at which the minimum volume of said internal open space is 0.3 Ah thereby restricting such piston excursions within a range for which said air spring stiffness is substantially constant, and further providing sufficient magnitude for said air spring stiffness k, in combination with said selected mass m, to provide a magnitude of natural frequency $w_n$ of the air spring ram mass combination equal or sufficiently close to the selected frequency $w_o$ to insure driving said ram means during impacting operation into reciprocating excursions greater than said sufficiently short maximum excursion of the reciprocating output element thereby inducing dynamic amplification of the motion of said ram means.

5. The method of operating an impacting device of the type wherein a rotating crankshaft having at least one crank thereon actuates resilient coupler means mounted on a frame to drive ram means into impacting motion against impact tool means upon each rotation of the crankshaft, and the resilient coupler means comprises a hollow cylinder with at least one end element enclosing at least one end of the cylinder, with the ram means including a piston slidably mounted in the cylinder and arranged to form a single acting air spring having an internal open space of variable volume in the cylinder upon rotation of the crankshaft, wherein the method comprises:

for a selected frequency $w_o$ of crankshaft rotation and a selected mass m of said ram means; providing a sufficiently short crank length and, in combination therewith, selecting the piston with sufficient cross-sectional area A normal to the path of piston motion and arranging the position of the impact tool means relative to the cylinder to position the mean point of impact of the ram means to enclose a substantially constant quantity of air of volume Ah providing air spring stiffness k for said resilient coupler means of sufficient magnitude to limit ram piston travel toward said at least one end element during impacting operation to the point in ram piston travel at which the minimum volume of said internal open space is 0.3 Ah thereby restricting such ram excursions within a range for which said air spring stiffness is substantially constant, and further providing sufficient magnitude for said air spring stiffness k, in combination with said selected mass m, to provide a magnitude of natural frequency $w_n$ of the air spring ram mass combination equal or sufficiently close to the selected frequency $w_o$ of said rotating crankshaft to insure driving said ram means during impacting operation into reciprocating excursions greater than said sufficiently short crank length thereby inducing dynamic amplification of the motion of said ram means.

* * * * *